US009261013B2

(12) United States Patent
Koo et al.

(10) Patent No.: US 9,261,013 B2
(45) Date of Patent: Feb. 16, 2016

(54) RESERVOIR TANK FOR AN AUTOMOBILE

(75) Inventors: Ki Sam Koo, Daejeon (KR); Shin-Won Yun, Daejeon (KR); Yong Chin Song, Daejeon (KR); Sang Hyun Lee, Daejeon (KR); Ok Ryul Min, Daejeon (KR); Jun Ho Kim, Daejeon (KR); Se Young Park, Daejeon (KR)

(73) Assignee: HANON SYSTEMS, Daejeon-Si (KR)

( * ) Notice: Subject to any disclaimer, the term of this patent is extended or adjusted under 35 U.S.C. 154(b) by 1215 days.

(21) Appl. No.: 12/758,079

(22) Filed: Apr. 12, 2010

(65) Prior Publication Data

US 2010/0258570 A1 Oct. 14, 2010

(30) Foreign Application Priority Data

Apr. 13, 2009 (KR) ..... 10-2009-0031792
Nov. 30, 2009 (KR) ..... 10-2009-0116643

(51) Int. Cl.
*B65B 39/02* (2006.01)
*F16B 7/10* (2006.01)
*F01P 11/02* (2006.01)

(52) U.S. Cl.
CPC ..... *F01P 11/029* (2013.01); *B65B 39/02* (2013.01); *F01P 2070/52* (2013.01)

(58) Field of Classification Search
CPC . F01P 11/029; F01P 2070/52; F16B 2007/16; F16B 7/10; B65B 39/02; B65B 39/12; B60K 2015/0458; B60K 2015/0464; B67C 11/00; B67C 11/02; B67C 11/04; B67C 11/06
USPC ..... 165/70, 71, 72, 78, 132; 138/109; 141/251, 254, 257, 266, 275, 338, 59, 141/198, 353, 368; 220/86.3; 403/109.2, 403/109.3, 109.8, 329, DIG. 14
See application file for complete search history.

(56) References Cited

U.S. PATENT DOCUMENTS 1,420,011 A * 6/1922 Abbott ..... B67C 11/02 141/338
3,814,147 A * 6/1974 Lindberg ..... B67C 3/30 141/266

(Continued)

FOREIGN PATENT DOCUMENTS

JP 58-177521 U 11/1983
JP 07-269344 10/1995

(Continued)

OTHER PUBLICATIONS

CN Application No. 201010196060.7, Office Action dated Jul. 28, 2011.

*Primary Examiner* — Judy Swann
*Assistant Examiner* — John Higgins
(74) *Attorney, Agent, or Firm* — Hauptman Ham, LLP

(57) ABSTRACT

The present invention relates to a reservoir tank for an automobile, which is provided with a height-adjustable sub filler neck so as to be retracted when not in use and extracted when filling coolant, whereby the reservoir tank can be disposed low in the automobile. The reservoir tank forming a cooling module together with a condenser, a radiator and a fan and shroud assembly is disposed at a carrier, and includes a filler neck for filling coolant and a cap for closing the filler neck, and is communicated with a radiator so as to control an amount of the coolant in the radiator, wherein the reservoir tank is integrally formed with a shroud of the fan and the shroud assembly, and the filler neck is formed with a sub filler neck which is retracted into and extracted from the filler neck.

6 Claims, 7 Drawing Sheets

(56) References Cited

U.S. PATENT DOCUMENTS

| | | | | | |
|---|---|---|---|---|---|
| 4,630,748 | A | * | 12/1986 | Keller | 220/86.3 |
| 4,832,637 | A | * | 5/1989 | Goluba | 440/83 |
| 5,012,768 | A | | 5/1991 | Roschinski | |
| 5,174,676 | A | * | 12/1992 | Welsch et al. | 403/14 |
| 5,894,872 | A | * | 4/1999 | Gale | 141/368 |
| 5,950,695 | A | * | 9/1999 | Smith | 141/326 |
| 6,223,793 | B1 | * | 5/2001 | Donoughe et al. | 141/338 |
| 2006/0198694 | A1 | * | 9/2006 | Weiser et al. | 403/329 |

FOREIGN PATENT DOCUMENTS

| | | | |
|---|---|---|---|
| JP | 08-072563 | | 3/1996 |
| JP | 2003-056346 | | 2/2003 |
| JP | 2003-120297 | | 4/2003 |
| JP | 2003-214163 | | 7/2003 |
| JP | 2004-011615 | | 1/2004 |
| KR | 1019990027657 | A | 4/1999 |
| KR | 1020070055274 | A | 5/2007 |

* cited by examiner

Fig. 1 - Prior Art
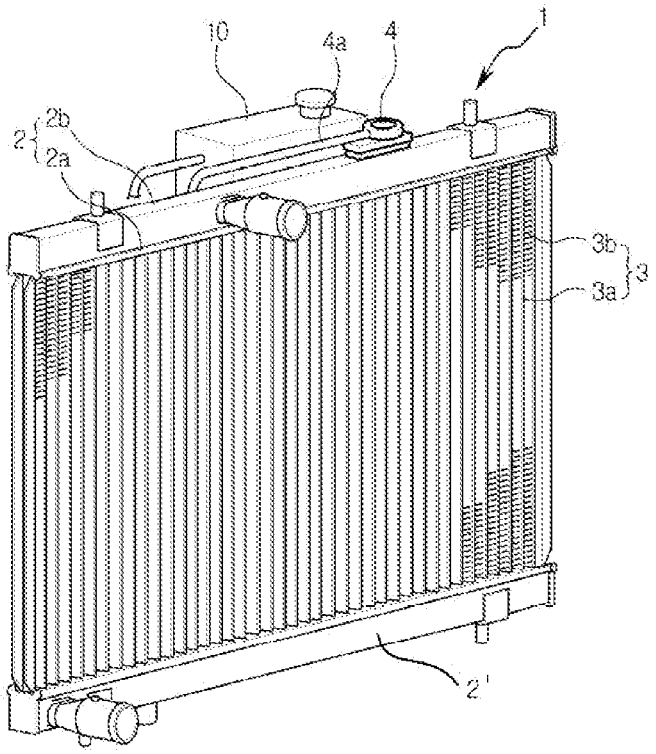
Fig. 2 - Prior Art
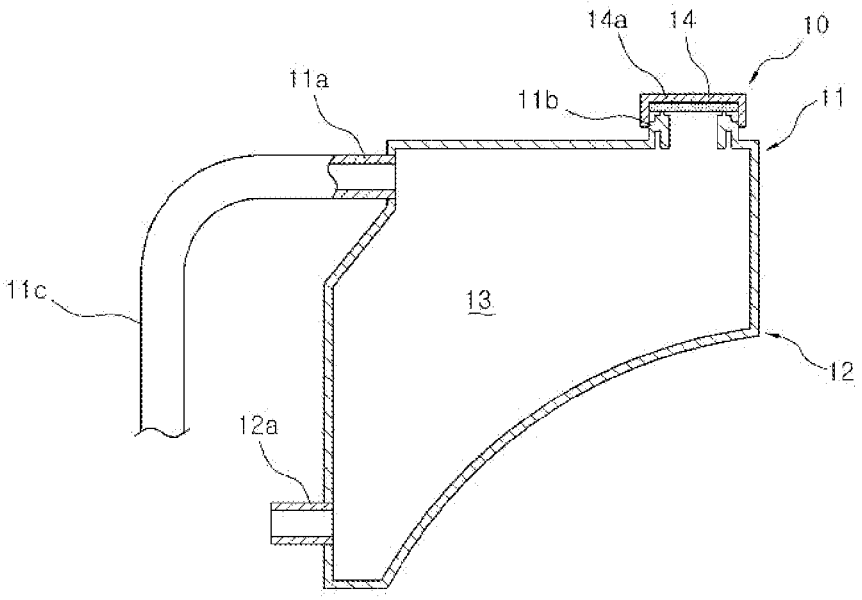

RESERVOIR TANK FOR AN AUTOMOBILE

CROSS-REFERENCE(S) TO RELATED APPLICATIONS

The present invention claims priority of Korean Patent Application No. 10-2009-0031792 (filed on Apr. 13, 2009) and Korean Patent Application No. 10-2009-0116643 (filed on Nov. 30, 2009), which is incorporated herein by reference.

BACKGROUND OF THE INVENTION

1. Field of the Invention

The present invention relates to a reservoir tank for an automobile and, more particularly, to a reservoir tank for an automobile, which is provided with a height-adjustable sub filler neck so as to be retracted when not in use and extracted when filling coolant, whereby the reservoir tank can be disposed low in the automobile.

2. Description of Related Art

In an automobile having an internal combustion engine, generally, heat generated in the engine is transferred to a cylinder head, a piston, a valve and the like. Thus, if temperature of such components is excessively increased, the strength of the components is lowered due to thermal expansion and deterioration thereof, and the durability of the engine is reduced, and knocking or pre-ignition phenomenon occurs due to a poor combustion state and thus the engine power is reduced.

In addition, if the engine is not cooled sufficiently, an oil film formed on an internal surface of a cylinder is stopped, thereby degenerating lubrication performance. Further, engine oil is deteriorated, and thus the cylinder may be worn out abnormally. Furthermore, the piston may be bonded to the inner surface of the cylinder.

In order to cool the engine, the automobile is typically provided with a water-cooled cooling apparatus.

The water-cooled cooling apparatus functions to lower temperature of the cylinder block and the cylinder head, while the coolant is circulated therethrough by a water pump. The water-cooled cooling apparatus includes a radiator for radiating heat of the coolant, a cooling fan and a thermostat.

Meanwhile, a reservoir tank 10 forming a cooling module together with a condenser, a radiator 1 and a fan and shroud assembly is provided at a carrier. This is called as a front end module.

FIG. 1 is a perspective view of a conventional reservoir tank 10, and FIG. 2 is a cross-sectional view of the conventional reservoir tank 10.

Referring to FIG. 1, the radiator 1 functions to cool the coolant of which temperature is increased while being passed through an engine. The radiator 1 basically includes an upper/lower tank assembly 2, 2', and a radiator core 3 having a tube 3*a* and a fin 3*b* interposed between the fins 3*b*.

The upper/lower tank assembly 2, 2' may be formed by a header 2*a* which is coupled with the tube 3*a* of the radiator core 3, and a tank 2*b* which encloses the header 2*a* so as to form a passage.

Meanwhile, internal pressure of the radiator 1 may be excessively increased due to change in temperature and volume of the radiator 1 while the coolant is flowed therein. Also there may be not sufficient coolant in the radiator 1.

In order to solve the above-mentioned problems, the radiator 1 is communicated with the reservoir tank 10 (subsidiary tank) such that the coolant in the radiator 1 is discharged to the reservoir tank 10 when the internal pressure of the radiator 1 is excessively increased, and the coolant is supplied to the radiator 1 when the internal pressure or temperature is lowered.

The reservoir tank 10 is formed with a filler neck 4. In general, an overflow pipe 4*a* is formed at the side of the filler neck 4 and connected with the radiator 1.

At the filler neck 4, there is provided a radiator cap which has a pressure vale for closing an opened portion.

More detailedly, referring to FIG. 2, an upper tank 11 and a lower tank 12 of which a lower portion and an upper portion faced to each other are opened are coupled with each other so as to form a coolant storing portion 13.

A coolant discharging port 11*a* is formed at a side of the upper tank 11 so as to discharge the coolant to an outside when the coolant stored in the reservoir tank 10 is over a desired amount, and a filler neck 11*b* for injecting the coolant is formed at an upper side of the upper tank 11 so as to be protruded more than an upper surface thereof.

The coolant discharging port 11*a* is connected with a drain hose 11*c*, and the filler neck 11*b* is closed by a detachable cap 14. A cap sealing portion 14*a* is provided at an inner surface of the cap 14 so as to be closely contacted with the filler neck 11*b*, thereby preventing the coolant from being leaked.

A coolant inlet port 12*a* is provided at a side of the lower tank 12 and connected with the overflow pipe 4*a* (referring to FIG. 1) of the filler neck 4.

However, in the conventional reservoir tank for an automobile, the filler neck 11*b* is integrally formed with the reservoir tank 10. If the filler neck 11*b* has a too low height, it is not facile to inject the coolant due to a narrow space. But if the filler neck 11*b* has a too high height to enhance user's convenience, it requires many spaces in an engine room, and thus there is a problem in layout.

Moreover, if the filler neck 11*b* has a too low height, it may cause increased injuries to an accident victim when a car accident occurs.

Recently, there has been proposed a method in which the reservoir tank is disposed at the fan and shroud assembly in order to increase space efficiency in the engine room and also to improve productivity.

However, in case that the reservoir tank is disposed at the shroud assembly, the cooling module is installed in the carrier, and the reservoir tank is thus moved to the side of the carrier. Therefore, it is difficult by an upper member of the carrier to secure a space for forming the filler neck, and also since a distance from the filler neck is spaced apart due to a height of the upper member, it is further difficult to inject the coolant.

SUMMARY OF THE INVENTION

An embodiment of the present invention is directed to providing a reservoir tank for an automobile, which is provided with a sub filler neck so as to be extracted when filling coolant, thereby facilely injecting the coolant.

Another embodiment of the present invention is directed to providing a reservoir tank for an automobile, in which the reservoir tank can be disposed at a lower place, thereby improving the space efficiency.

To achieve the object of the present invention, the present invention provides a reservoir tank for an automobile comprising: a filler neck for filling coolant; a cap for closing the filler neck; and a sub filler neck which is retracted into and extracted from the filler neck; wherein the reservoir tank, which is integrally formed with a shroud of the fan and the shroud assembly, forms a cooling module disposed at a carrier, together with a condenser, a radiator and a fan and shroud assembly and which is communicated with a radiator so as to control an amount of the coolant in the radiator.

Preferably, the sub filler neck 200 is formed into a hollow pipe shape, and formed with a flange portion 240 which is caught by the filler neck 110 so as to restrict an extracted level of the sub filler neck 200.

Preferably, the sub filler neck 200 is further formed with a protrusion 230 which prevents the sub filler neck 200 from being separated from the filler neck 110.

Preferably, a desired part of the sub filler neck 200 is maintained in a state of being extracted to an upper side of the filler neck 110, when filling the coolant.

Preferably, the sub filler neck 200 further includes a stopper 210 which is elastically protruded at an upper portion of the protrusion 230 to be caught by an upper end of the filler neck 110. And the stopper 210 is formed at both sides of the sub filler neck 200, and both side portions and a lower circumferential portion of the stopper 210 are cut off.

Preferably, the reservoir tank further includes at least one or more guides 220 which is formed at an outer surface of the sub filler neck 200 so as to be elongatedly protruded in a length direction, and a guide groove 111 which is formed at inner surfaces of the filler neck 110 and the reservoir tank 100 connected with the filler neck 110 to be corresponding to the guide 220 of the sub filler neck 200, and which functions to guide retraction and expansion of the sub filler neck 200.

Preferably, the sub filler neck is formed with a communication hole 250 which is formed to be adjacent to the filler neck 110 and which is communicated with the reservoir tank 100.

Preferably, the sub filler neck 200 is further formed with a catching protrusion 260 which is formed at an inner upper side of the sub filler neck 200 so as to have a desired height.

Preferably, the filler neck 110 is formed to be inclined at a desired angle in an upper direction and an internal direction of an engine room.

BRIEF DESCRIPTION OF THE DRAWINGS

FIG. 1 is a perspective view of a conventional reservoir tank.

FIG. 2 is a cross-sectional view of the conventional reservoir tank.

[Detailed Description of Main Elements]

| | |
|---|---|
| 100: reservoir tank of automobile | |
| 110: filler neck | 111: guide groove |
| 120: cap | 121: sealing member |
| 200: sub filler neck | 210: stopper |
| 220: guide | 230: protrusion |
| 240: flange portion | 250: communication hole |
| 260: catching protrusion | |
| 310: condenser | 320: radiator |
| 330: carrier | 340: fan and shroud assembly |
| 341: shroud | |

DESCRIPTION OF SPECIFIC EMBODIMENTS

The advantages, features and aspects of the invention will become apparent from the following description of the embodiments with reference to the accompanying drawings, which is set forth hereinafter.

Figure 3:
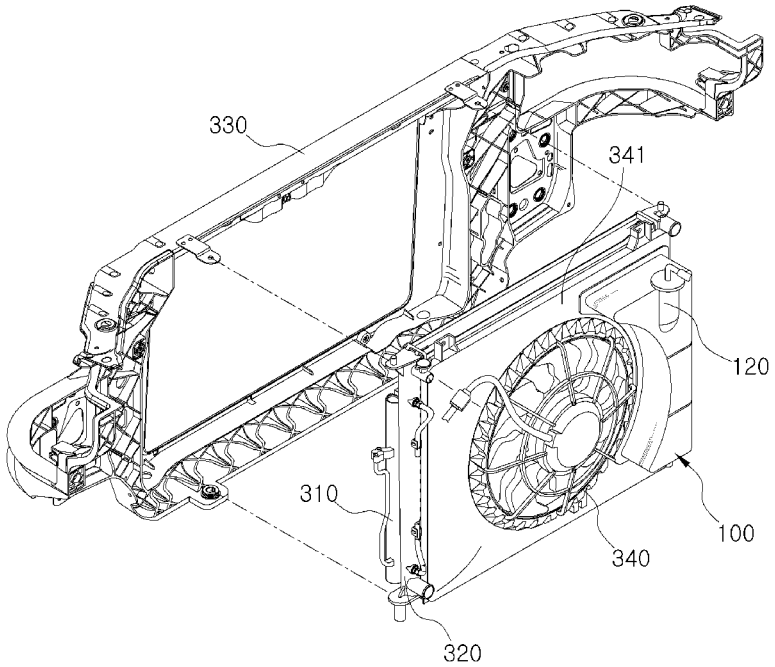
FIG. 3 is a perspective view of a reservoir tank of an automobile in accordance with the present invention.
Figure 4:
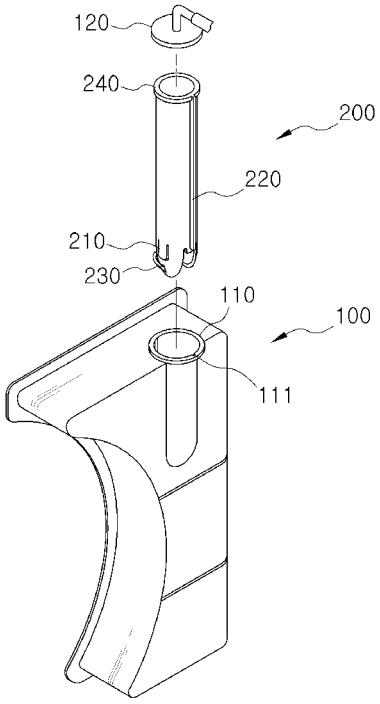
FIGS. 4 and 5 are an exploded perspective view and a perspective view of the reservoir tank of the automobile in accordance with the present invention (when filling coolant).
Figure 5:
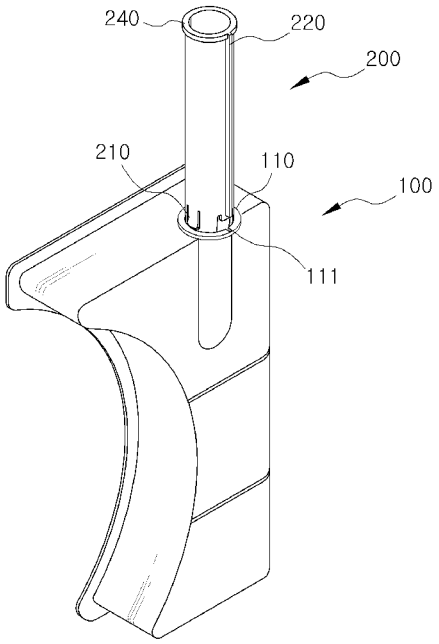
Figure 6:
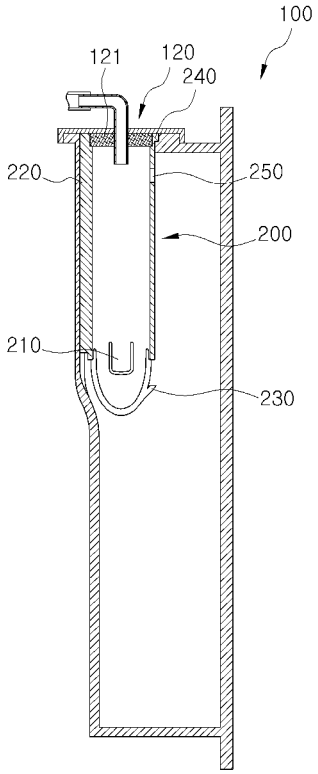
FIGS. 6 and 7 are cross-sectional views of the reservoir tank of the automobile in accordance with the present invention, when running the automobile and filling the coolant.
Figure 7:
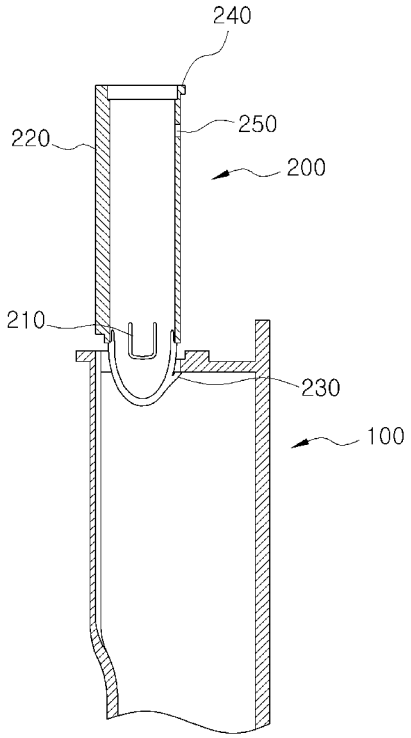
Figure 8:
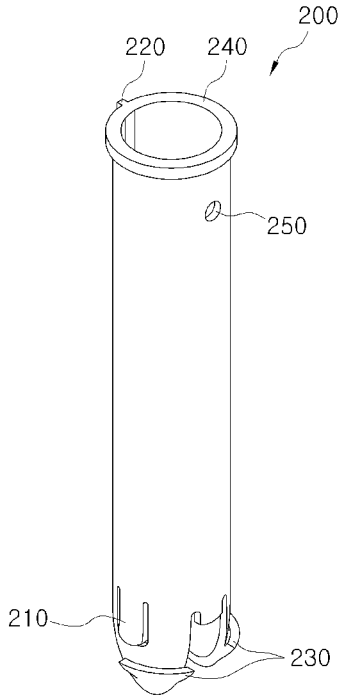
FIG. 8 is a perspective view of a sub filler neck of the reservoir tank of the automobile in accordance with the present invention.
Figure 9:
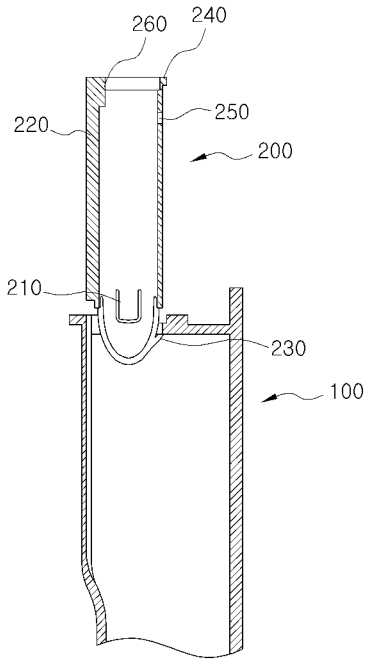
FIG. 9 is another cross-sectional view of the reservoir tank of the automobile in accordance with the present invention.

FIG. 3 is a perspective view of a reservoir tank 100 of an automobile in accordance with the present invention, FIGS. 4 and 5 are an exploded perspective view and a perspective view of the reservoir tank 100 of the automobile in accordance with the present invention (when filling coolant), FIGS. 6 and 7 are cross-sectional views of the reservoir tank 100 of the automobile in accordance with the present invention, when running the automobile and filling the coolant, FIG. 8 is a perspective view of a sub filler neck 200 of the reservoir tank 100 of the automobile in accordance with the present invention, and FIG. 9 is another cross-sectional view of the reservoir tank of the automobile in accordance with the present invention.

The reservoir tank 100 of the automobile according to the present invention is formed with a desired space for storing coolant, which is communicated with a radiator so as to control an amount of the coolant. The reservoir tank 100 includes a filler neck 110 which is opened to fill the coolant, a sub filler neck 200 which is provided at the filler neck 110, and a cap 120 which closes the filler neck 110.

The reservoir tank 100 of the automobile according to the present invention is communicated with the radiator so as to store the coolant overflowed by excessive internal pressure of the radiator and also to move the coolant into the radiator when the coolant is insufficient in the radiator, thereby uniformly maintaining a coolant level in the radiator.

The filler neck 110 is formed to be opened at a side of the reservoir tank 100. And the filler neck 110 is formed at an upper surface of the reservoir tank 100 so as to increase a capacity of the reservoir tank 100 and facilely fill the coolant. Also the filler neck 110 is protruded to be closed and opened by the cap 120.

The cap 120 for closing and opening the filler neck 110 may further includes a sealing member 121 at an inside thereof.

The cap 120 functions to close the filler neck 110 when the automobile is running and open the filler neck 110 when the coolant is filled.

The reservoir tank 100 for the automobile, which forms a cooling module together with a condenser 310, a radiator 320 and a fan and shroud assembly 340 is disposed at a carrier. Preferably, the reservoir tank 100 is integrally formed with a shroud 341 of the fan and shroud assembly 340 so as to be facilely fabricated and also to increase space efficiency.

Herein, since the reservoir tank 100 is integrally formed with the shroud 341, it is difficult to secure a sufficient space for filling the coolant. In order to prevent difficulty in the filling of the coolant due to the carrier 320, the sub filler neck 200 is provided.

The sub filler neck 200 has a construction which is retracted into or extracted from the filler neck 110. When the automobile is running, the sub filler neck 200 is retracted into the filler neck 110 and fixed by the cap 120, and when the coolant is filled, the sub filler neck 200 is extracted upward so as to guide the filling of the coolant, after the cap 120 is removed.

In the prior art, since a radiator tank has a high height so as to facilely fill the coolant, it is difficult to design it.

However, the reservoir tank 100 for the automobile according to the present invention is fabricated on the basis of a basic design such as a coolant storing capacity and a front end module construction, and the sub filler neck 200 is disposed to be inserted into the filler neck 110. Then, the sub filler neck 200 is selectively extracted from the filler neck 110 when filling the coolant, thereby facilely injecting the coolant. Furthermore, since it is not necessary to have a high height, it is possible to minimize a size thereof.

In addition, since the reservoir tank 100 for the automobile according to the present invention has a low height, it is possible to reduce injuries to an accident victim when a car accident occurs.

Hereinafter, the sub filler neck 200 will be described more detailedly.

The sub filler neck 200 is formed into a hollow pipe shape. Also, the sub filler neck 200 is formed with a flange portion 240 so as to be positioned at an uppermost portion when inserted into the filler neck 110.

The flange portion 240 is protruded outside from an upper circumference of the sub filler neck 200 to be stepped and thus stopped at the upper portion of the filler neck 110, thereby restricting the retraction of the sub filler neck 200.

The sub filler neck 200 may further include a protrusion 230 which is formed at an outer circumference thereof so as to prevent separation from the filler neck 110.

The protrusion 230 may be formed into various shape so as to be contacted with an inner lower surface of the filler neck 110 and thus prevent the sub filler neck 200 from being separated.

In the drawings, for example, the protrusion 230 is formed at a lower side of the sub filler neck 200 to be inclinedly protruded. Therefore, the sub filler neck 200 is facilely inserted into the reservoir tank 100 but stopped at a desired height when being extracted.

In other words, by the protrusion 230, the sub filler neck 200 is easily inserted along an inclined portion of the protrusion 230 into the filler neck 110 when assembling the sub filler neck 200 into the filler neck 110, but it is not facile to separate it from the filler neck 110.

Preferably, a lower side of the sub filler neck 200 is partially cut off so as to be facilely inserted into the filler neck 110.

Preferably, when filling the coolant, the sub filler neck 200 is maintained in a state that a desire part of the sub filler neck 200 is extracted upward from the filler neck 110, thereby facilely filling the coolant. To this end, the reservoir tank 100 of the present invention may further have a stopper 210.

The stopper 210 is elastically protruded outside to be stopped at an upper end of the filler neck 110, and formed at an upper side of the protrusion 230.

The protrusion 230 functions to limit an extracted level of the sub filler neck 200, and the stopper 210 functions to maintain an extracted state of the sub filler neck 200.

The stopper 210 is inclined in a lower outer direction so as to be facilely moved in an upper direction (that the sub filler neck 200 is extracted) but not in a lower direction (that the sub filler neck 200 is inserted).

The stopper 210 may be formed at both sides of the sub filler neck 200 so as to stably fix it. Both side portions and a lower circumferential portion of the stopper 210 are cut off so that the stopper 210 has elasticity, whereby the sub filler neck 200 can be facilely inserted into the reservoir tank 100 by downward force after the filling of the coolant is finished.

A distance between the protrusion 230 and the stopper 210 is formed to be larger than a forming height of the filler neck 110, so that the sub filler neck 200 can be facilely stopped and fixed.

In the reservoir tank 100 for the automobile of the present invention, a guide 220 may be formed at the sub filler neck 200, and a guide groove 111 may be formed at inner surfaces of the filler neck 110 and the reservoir tank 100 connected with the filler neck 110.

The guide 220 is formed on an outer surface of the sub filler neck 200 to be elongatedly protruded in a length direction.

The guide groove 111 is formed to be corresponding to the guide 220 and functions to guide the retraction and expansion of the sub filler neck 200.

In the reservoir tank 100 for the automobile of the present invention, since the guide 220 is guided by the guide groove 11 when the sub filler neck 200 is retracted and extracted, it is possible to stably fix the sub filler neck 200 and thus it is prevented to generate a noise due to rolling of the sub filler neck 200.

The guide groove 111 may be formed to have a length corresponding to a height of the guide 220 or formed only at a desired region of the inner surfaces of the filler neck 110 and the reservoir tank 100 connected with the filler neck 110.

In the drawings, as an example, one guide 220 and one guide groove 111 are provided. However, two or more guides 220 and guide grooves 111 may be formed, if necessary.

In the reservoir tank 100 of the present invention, as shown in FIG. 8, a communication hole 250 may be further formed at a side of the sub filler neck 200 so as to be communicated with the reservoir tank 100.

In case that the sub filler neck 200 is formed, a pressure difference may be generated between the sub filler neck 200 and the reservoir tank 100. In this case, the coolant may be overflowed in a state of being not fully filled in the reservoir tank 100. However, since the reservoir tank 100 of the present invention has the communication hole 250 for communicating the sub filler neck 200 and the reservoir tank 100, the pressure difference does not occur.

Preferably, the communication hole 250 has a diameter in which a part of a finger of an operator can be inserted, and thus the operator can facilely extract the sub filler neck 200 in a state that the operator's finger is inserted into the communication hole 250.

Furthermore, as shown in FIG. 9, the reservoir tank 100 for the automobile according to the present invention may further includes a catching protrusion 260 which is formed at an inner upper side of the sub filler neck 200 so as to have a desired height.

Like the communication hole 250, the height of the catching protrusion 260 functions to allow the operator to facilely extract the sub filler neck 200 in the state that the operator's finger is fixed to it. The catching protrusion 260 has a desired height and width that the operator's finger is fixed to it without interruption in the filling of the coolant.

The catching protrusion 260 and the communication hole 250 may be formed at the same time so as to be selectively used by the operator. Otherwise, one of the catching protrusion 260 and the communication hole 250 may be formed selectively.

Figure 10:
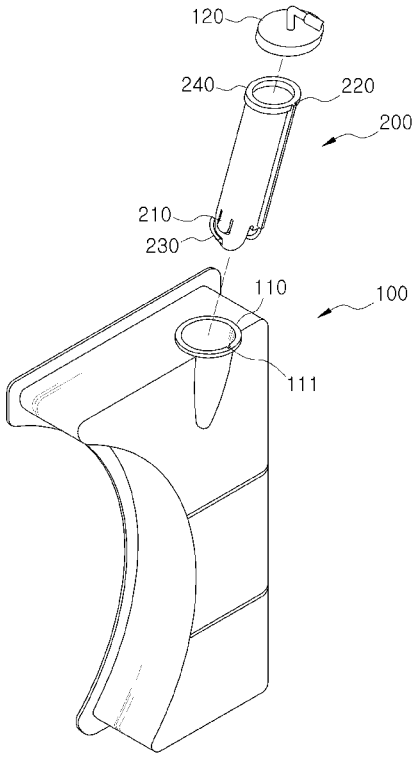
FIG. 10 is another exploded perspective view of the reservoir tank of the automobile in accordance with the present invention.
Figure 11:
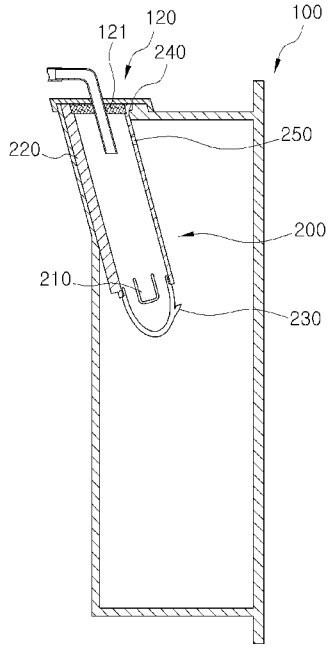
FIGS. 11 and 12 are cross-sectional views of the reservoir tank of the automobile in accordance with the present invention, when running the automobile and filling the coolant.
Figure 12:
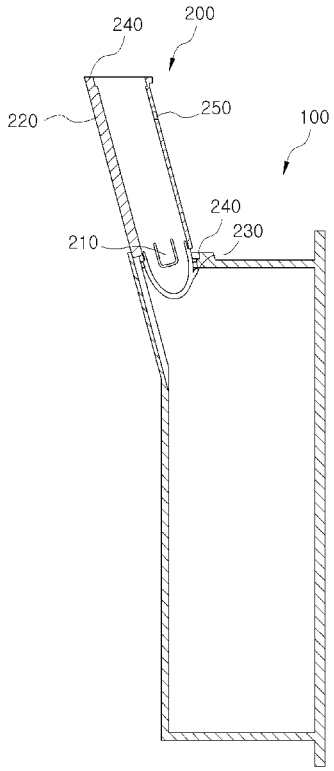
Figure 13:
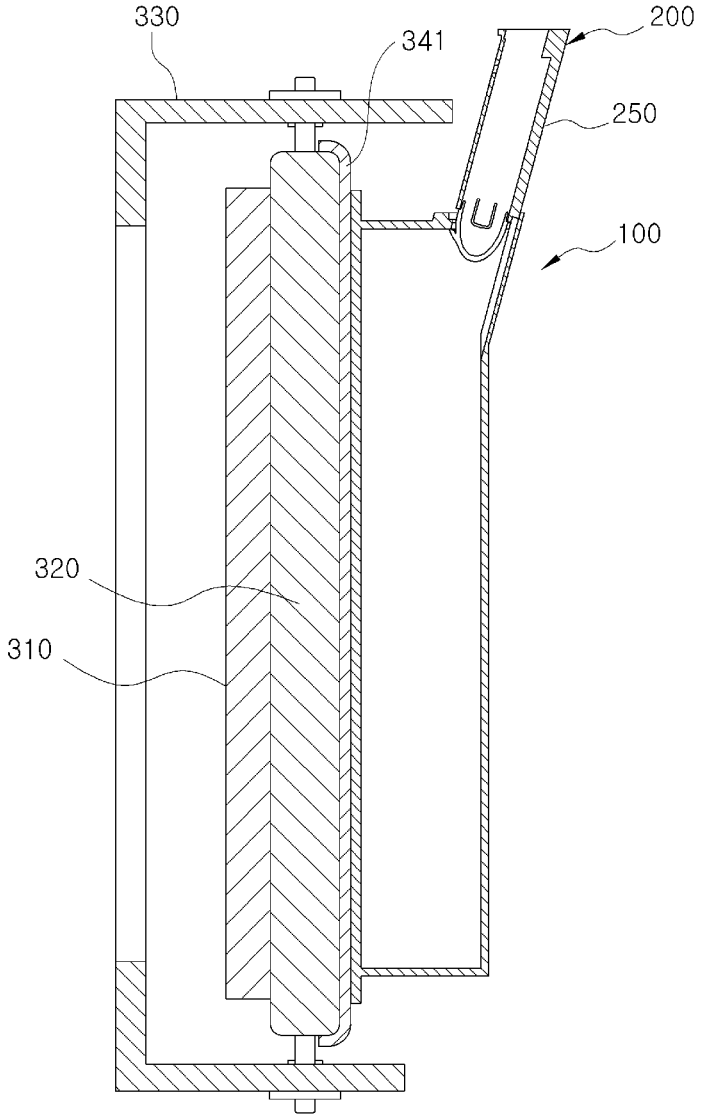
FIG. 13 is a cross-sectional view of cross-sectional view showing a status that the reservoir tank is installed in the automobile in accordance with the present invention.

FIG. 10 is another exploded perspective view of the reservoir tank 100 of the automobile in accordance with the present invention, FIGS. 11 and 12 are cross-sectional views of the reservoir tank 100 of the automobile in accordance with the present invention, when running the automobile and filling the coolant, and FIG. 13 is a cross-sectional view of cross-sectional view showing a status that the reservoir tank 100 is installed in the automobile in accordance with the present invention.

In the reservoir tank 100 for the automobile according to the present invention, as shown in FIGS. 10 to 13, the filler neck 110 may be inclined at a desired angle.

Herein, an inclined direction of the filler neck 110 is an upper direction and an internal direction of an engine room, and also the direction is the same as that of an upper member of the carrier 330.

In the reservoir tank 100 of the automobile of the present invention, since the sub filler neck 200 is moved along the filler neck 110, the sub filler neck 200 is also positioned inclinedly. Thus, the operator can easily retract and extract the sub filler neck 200, and the coolant can be facilely filled.

Recently, in order to reduce the injuries to an accident victim when a car accident occurs, an entire height of a front end module (FEM) becomes lower to form a space between a bonnet and the FEM, and thus a height of the carrier 330 forming a basic body of the FEM becomes also lower. And the cooling module including the reservoir tank 100 provided at the carrier 330, the condenser 310, the radiator 320 and the fan and shroud assembly 340 is also formed to be corresponding to the carrier 330 and then moved to a front side of the automobile.

Herein, it is difficult to sufficiently secure an area corresponding to the filler neck 110 due to an upper portion of the carrier 330.

In the reservoir tank 100 for the automobile of the present invention, since the filler neck 110 is formed to be inclined at a desired angle toward the upper side and the engine room, it is facile to retract and extract the sub filler neck 200, although the entire height of the FEM becomes lower as described above.

According to the present invention as described above, since the reservoir tank 100 has the sub filler neck 200 which is retracted when filling the coolant, it is possible to facilely fill the coolant. And since the reservoir tank can be disposed low, it is possible to increase the space efficiency and also to reduce the injuries to the accident victim when the car accident occurs.

As described above, the reservoir tank of the automobile of the present invention has the sub filler neck which is extracted when filling the coolant, thereby facilely injecting the coolant.

In addition, the sub filler neck has a simple structure which is retracted into the reservoir tank and fixed by a cap when running the automobile (i.e., not in use), and extracted when filling the coolant, whereby it can be easily and facilely used.

Further, since the reservoir tank of the automobile of the present invention may have a low height, it is possible to increase the space efficiency and also to reduce injuries to an accident victim when a car accident occurs.

While the present invention has been described with respect to the specific embodiments, it will be apparent to those skilled in the art that various changes and modifications may be made without departing from the spirit and scope of the invention as defined in the following claims.

What is claimed is:

1. A reservoir tank for an automobile comprising:

a filler neck for filling coolant;

a cap for closing the filler neck; and a sub filler neck configured to be retracted into and extracted from the filler neck;

wherein the reservoir tank is integrally formed with a shroud of a fan and shroud assembly, is disposed at a carrier together with a condenser, a radiator, and the fan and shroud assembly, and is communicated with the radiator so as to control an amount of the coolant in the radiator, wherein the sub filler neck has a hollow pipe shape, and comprises:

a flange portion at an upper end thereof configured to be caught by the filler neck so as to restrict a retracted level of the sub filler neck;

a protrusion at an outer circumference of a lower end thereof, configured to prevent the sub filler neck from being separated from the filler neck; and a stopper elastically protruded at an upper portion of the protrusion, wherein the stopper and the protrusion are inclined outwardly from the sub filler neck, outward inclination of the protrusion is upward such that the upper portion of the protrusion is farther from the outer circumference than a lower portion of the protrusion is from the outer circumference, and outward inclination of the stopper is downward and toward the protrusion so that an extracted state of the sub filler neck is maintained by the filler neck being fixed between an upper surface of the protrusion and a lower surface of the stopper, wherein the stopper is formed at both sides of the sub filler neck, and both side portions and a lower circumferential portion of the stopper are cut off, whereby the lower circumferential portion of the stopper has a free end which is separated from the outer circumference of the sub filler neck.

2. The reservoir tank of claim 1, further comprising at least one or more guides formed at an outer surface of the sub filler neck so as to be elongatedly protruded in a length direction, and a guide groove formed at inner surfaces of the filler neck and the reservoir tank connected with the filler neck, the guide groove corresponding to the guide of the sub filler neck and configured to guide retraction and expansion of the sub filler neck.

3. The reservoir tank of claim 1, wherein the sub filler neck further comprises a communication hole adjacent to the filler neck and communicated with the reservoir tank.

4. The reservoir tank of claim 1, wherein the sub filler neck further comprises a catching protrusion at an inner upper side of the sub filler neck so as to have a predetermined height.

5. The reservoir tank of claim 1, wherein the filler neck is formed to be inclined at a predetermined angle in an upper direction and a direction of an upper member of the carrier.

6. The reservoir tank of claim 1, wherein the stopper is capable of being compressed into the sub filler neck so as to enable retraction of the sub filler neck from the extracted state of the sub filler neck.

* * * * *